United States Patent [19]

Green et al.

[11] Patent Number: 4,462,734

[45] Date of Patent: Jul. 31, 1984

[54] BULK TOBACCO RACKING DEVICE

[76] Inventors: John C. Green, Rte. 1, Box 208, Lillington, N.C. 27546; Ronald E. Wheeler, Rte. 3, Angier, N.C. 27501

[21] Appl. No.: 397,111

[22] Filed: Jul. 12, 1982

[51] Int. Cl.[3] ..... A24B 1/10

[52] U.S. Cl. ..... 414/26; 294/5.5; 414/786

[58] Field of Search ..... 414/26, 786; 294/5.5; 56/27.5

[56] References Cited

U.S. PATENT DOCUMENTS

| | | | |
|---|---|---|---|
| 2,380,415 | 7/1945 | Carruthers | 414/429 |
| 2,491,034 | 12/1949 | Couch | 414/429 |
| 2,767,862 | 10/1956 | Holloway, Sr. | 414/26 |
| 3,083,517 | 3/1963 | Wilson | 414/26 X |
| 3,095,230 | 6/1963 | Long | 56/27.5 X |
| 3,244,445 | 3/1966 | Wilson | 294/5.5 |
| 4,016,985 | 3/1977 | Green et al. | 294/5.5 X |
| 4,379,669 | 3/1983 | Wilson | 414/26 X |

*Primary Examiner*—Leslie J. Paperner
*Assistant Examiner*—Janice Krizek
*Attorney, Agent, or Firm*—Mills & Coats

[57] ABSTRACT

The present invention relates to a bulk tobacco racking device that is designed to assist in loading and closing a sectional bulk tobacco rack of the type including a generaly U-shaped tine section, an elongated bar section, and a pair of latches that extend from said tine section which are adapted to engage and latch with said elongated bar section. The racking device of the present invention comprises a frame structure having a bottom and a pair of laterally spaced side frame assemblies disposed on opposite sides thereof for receiving respective sections of the rack during the loading and racking operation. At least one of said side frame assemblies is laterally adjustable to assure that the respective rack sections are properly fitted and disposed between the side frame assemblies. Each side frame assembly includes a guide structure for engaging a flange extending from the respective ends of said tine section such that the tine section is maintained in proper alignment as the same is pushed downwardly into engagement with said elongated bar section.

10 Claims, 3 Drawing Figures

BULK TOBACCO RACKING DEVICE

FIELD OF INVENTION

The present invention relates to bulk tobacco curing and drying, and more particularly to a bulk tobacco racking device for receiving a sectional bulk tobacco rack and assisting in the loading thereof with tobacco leaf material and further functioning to guide and press one section into a latched relationship with the other section after loading.

BACKGROUND OF INVENTION

In the past fifteen years, tobacco farmers have continued to turn to bulk tobacco curing and drying. Prior to the acceptance of bulk tobacco curing, the conventional practice was curing and drying in a so called "stick barn". In a "stick barn" environment, a small amount of tobacco leaf material was tied in spaced apart bundles along a stick with each bundle including approximately two to three leaves. In a hanging environment within a stick barn, there were substantial air spaces between the leaf material for air to pass upwardly through the tobacco leaf material to effectuate curing and drying. Preparing tobacco for curing and drying in this manner was a very time consuming and laborious process.

With the advent of bulk curing and drying, as first developed and disclosed by F. J. Hassler in U.S. Pat. Nos. 3,105,713 and 3,110,326, tobacco leaf material was packed in relatively large bulk forms and disposed within a curing and drying structure. Because the tobacco was closely packed, it required that a fan system be employed to continuously force air through the bulk tobacco leaf material. This form of housing the tobacco for curing and drying substantially reduced the labor and time required in preparing the tobacco crop for curing and drying. As a result, bulk tobacco curing and drying has now been widely accepted and is especially used throughout the flue cured tobacco region of the United States.

In a bulk curing operation, it is conventional practice to utilize a sectional bulk tobacco rack. These racks are usually manufactured from metal and typically include a two sectional design, with the sections being separable. One section generally includes a U-shaped rack section with a plurality of tines extending therefrom. A second section includes an elongated bar that is adapted to attach across the tine section and to be latched thereto so as to confine the tobacco leaf material between the two sections. Once the dual sectional rack has been filled and the rack has been latched, the same can be disposed within a bulk tobacco curing and drying structure for curing and drying.

Because of the size and nature of these types of bulk tobacco racks, it is often difficult and time consuming to load them. In a typical loading operation, a form is provided and the form is adapted to receive the elongated bar section that is disposed about the bottom of the form. After the bar section has been so disposed, tobacco leaf material is piled across the bar section to a selected height with the form being so designed so as to retain the tobacco about side areas extending upwardly generally adjacent the end of the elongated bar section. Once a sufficient quantity of tobacco has been so disposed, then the tine section is placed over the quantity of tobacco, with the remote ends of the tines facing the tobacco. The tine section is then pushed downwardly through the tobacco leaf material towards the bottom disposed elongated bar section. The object is to push the tine section down into engagement with the elongated bar section such that latches disposed one each side of the tine section will appropriately engage the bar section to latch therewith and form a coupled relationship.

In the above process, it has always been very difficult to align the tine section with the elongated bar section so as to easily and precisely latch the two sections together. In addition, it requires substantial force and pressure to push the tine section and the individual tines through the tobacco leaf material that is to form the rack of tobacco material.

To assist in loading and unloading bulk tobacco racks of this general type, there has been some effort in designing a tobacco racking device. In this regard, one is referred to U.S. Pat. No. 4,016,985 which relates to such a device. The racking device disclosed in this patent has been very successful and is widely used by tobacco farmers throughout the flue cured tobacco region. With respect to this type of racking device, it is particularly noted that it is designed to accommodate a particular type of bulk tobacco rack. It is also especially designed to be used in unloading the rack after curing and drying. The type of rack that the racking device of U.S. Pat. No. 4,016,985 was designed for is the type of single tier rack that has been manufactured and sold by Harrington Manufacturing Company of Lewiston, N.C.

Besides the Harrington rack, there is a second general type of single tier bulk tobacco rack that is somewhat different in construction and which has been manufactured and sold throughout the flue cured tobacco region by Powell Manufacturing Company located in Bennettsville, S.C. Because of the particular design of this bulk tobacco rack, the racking table and structure disclosed in U.S. Pat. No. 4,016,985 was not particularly suited for nor compatible with the Powell type of rack. There, however, still remains a great need for a racking table and device that is particularly suited to work in conjunction with the Powell type rack.

SUMMARY OF INVENTION

The present invention provides a bulk tobacco racking device that is particularly adapted for use in conjunction with the Powell type single tier bulk tobacco rack of the type subsequently discussed herein and illustrated in FIG. 3. It should be pointed out at this time that the type of single tier rack being referred to is the type that simply includes an elongated bar section that in a loading operation is placed on a platform and tobacco leaf material disposed thereover. A second rack section, referred to as the tine section, is generally U-shaped and includes a plurality of tines extending downwardly therefrom. In addition, this rack includes about each end at least one outwardly extending flange. Also, about each end section is a spring steel latch that extends downwardly therefrom and is adapted to engage an end portion of the elongated bar section to create a latched or coupled relationship. Consequently, in a loading operation, the U-shaped tine section is pressed downwardly through the tobacco leaf material to a point where the same engages with and latches with the elongated bar section to form the closed bulk tobacco rack structure.

The present invention entails a tobacco racking device that includes a bottom structure for receiving the elongated bar section. Disposed about each side of the bottom structure is a side frame assembly, with at least one side frame assembly being adjustable laterally back and forth such that the elongated bar section can be securedly retained therebetween. In addition, each side frame assembly includes movable and biased side retaining means that form vertical side columns for retaining the tobacco leaf material about the racking device as the rack is loaded.

Finally, each side frame assembly includes a guiding structure that enables the outwardly projecting flanges of the tine section to be aligned therewith and to be inserted downwardly through the guiding structure as the tine section is pressed through the tobacco leaf material held within the rack. The presence of the guide structure provides for precise alignment of the two rack sections and generally assures that the tine section will be appropriately latched and secured to the elongated tine section once the tine section has been pressed downwardly through the tobacco leaf material.

In addition it follows that the bulk tobacco racking device of the present invention would include a press arm for engaging and pressing downwardly on the tine section as the same is directed through the tobacco leaf material towards engagement with the elongated bar section.

It is, therefore, an object of the present invention to provide a bulk tobacco racking device that will assist in the loading of a multi-sectional single tier bulk tobacco rack of the character having an elongated bar section and a generally U-shaped tine section.

A further object of the present invention resides in the provision of a bulk tobacco racking device for assisting in loading and closing of a dual sectional bulk tobacco rack of the type including a first section and a second tine section with the second tine section being adapted to latch to the first section, wherein the racking device is provided with means for positively engaging said tine section and guiding the same downwardly through tobacco leaf material towards the first section in precise alignment with the first section in order that the tine section can be easily and conveniently latched to the first section.

Another object of the present invention resides in the provision of a bulk tobacco racking device of the character referred to above that includes a pair of laterally spaced side frame assemblies for receiving the respective rack sections, and wherein at least one of the side frame assemblies includes means for laterally adjusting the same in order that the distance or span between the side frame assemblies can be precisely adjusted to accommodate the respective sections of certain bulk tobacco racks.

It is also an object of the present invention to provide a bulk tobacco racking device of the character referred to above wherein the same is provided with side retaining means that are movably mounted from an inside position to an outside position wherein in said inside position said side retaining means serve as a boundary or a post for confining tobacco along the side portions of the racking device during the racking operation, and wherein said side retaining means is provided with biasing means that bias the same towards said inside position but which allow said side retaining means to move towards said outside position in response to a filled and latched rack being pulled from the racking device.

Still a further object of the present invention resides in the provision of a bulk tobacco racking device of the character referred to above wherein there is provided guide structure that precisely aligns said tine section with said elongated bar.

It is also an object of the present invention to provide a bulk tobacco rack and device of the character referred to above that enables the closed rack to be directly pulled forwardly from the racking device without requiring parts of the racking device to be manually moved such as doors, etc.

Another object of the present invention is to provide a bulk tobacco rack loading device that is relatively simple in construction, easy to operate and which enables as few as one individual to load a conventional bulk tobacco rack without requiring the individual to exert a great amount of effort and labor.

Other objects and advantages of the present invention will become apparent from a study of the following description and the accompanying drawings which are merely illustrative of the present invention.

BULK TOBACCO RACKING DEVICE

Figure 3:
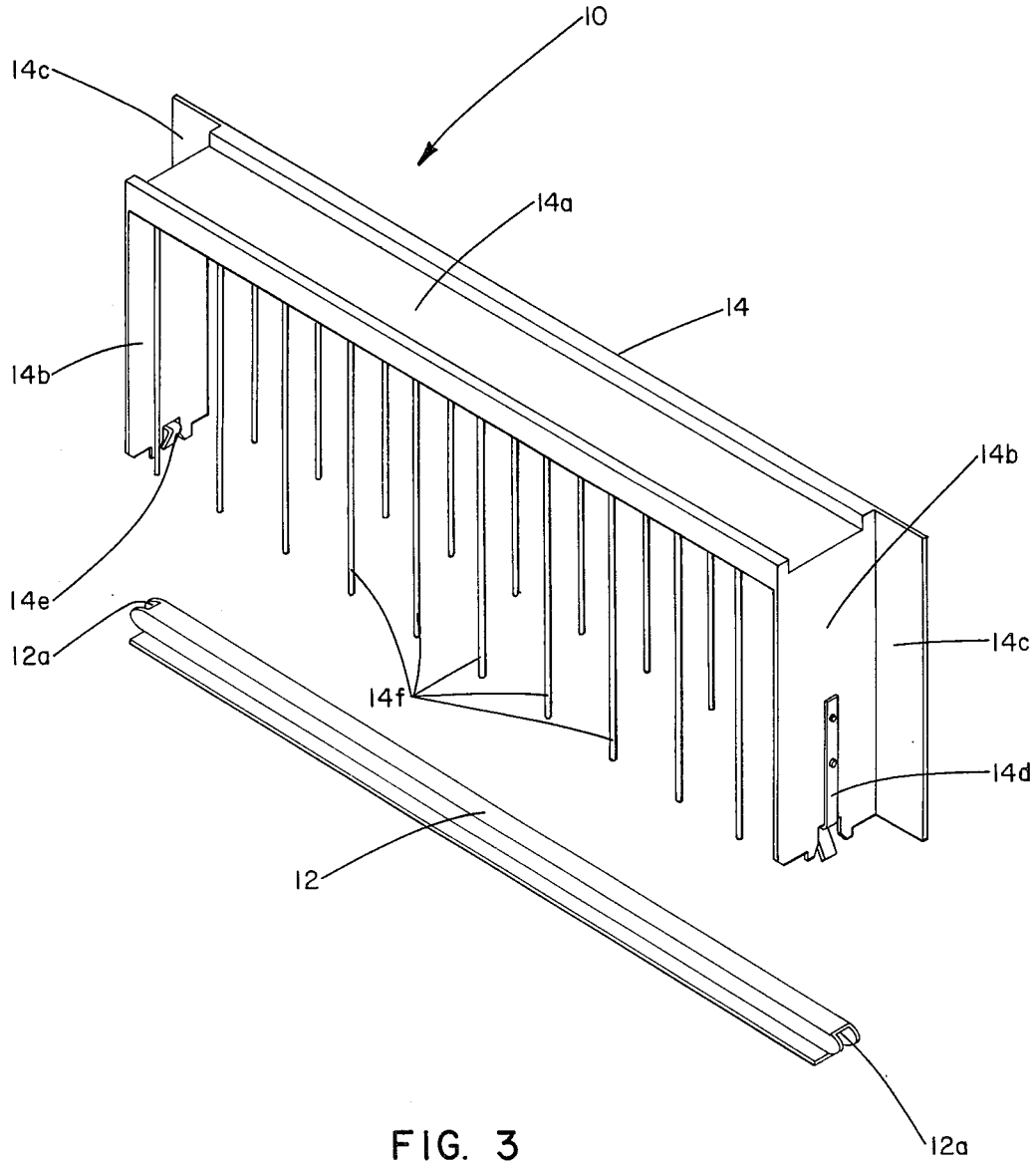
FIG. 3 is a perspective view of a type of dual sectional bulk tobacco rack for which the bulk tobacco racking device of the present invention was designed to accommodate.

With further reference to the drawings, in FIG. 3, there is shown a dual sectional single tier bulk rack, indicated generally by the numeral 10. Before proceeding with a discussion of the bulk tobacco racking device of the present invention, it will be beneficial to basically review the structure of bulk tobacco rack 10.

In this regard, it is seen that bulk tobacco rack 10 includes an elongated bar section 12 that includes a latch receiving area **12*a*** disposed about opposite ends thereof.

Designed to mate and be coupled with elongated bar section 12 is a generally U-shaped tine section indicated by the numeral 14. Tine section 14 includes a base **14*a* and a pair of ends 14*b*, with ends 14*b* being disposed at a 90 degree angle relative to base 14*a*. There is provided a plurality of tines 14*f* that are secured to base 14*a*** and extend therefrom.

Adjacent one edge of each end **14*b* is a flange 14*c* that extends at an angle of approximately 90 degrees with respect to the plane of the ends 14*b* as best illustrated in FIG. 3. Secured to the lower outside portions of each end 14*b* is a spring steel latch 14*d*. Latch 14*d* includes an inwardly projecting latching lip 14*e* that, as will be appreciated from subsequent portions of this disclosure, is adapted to engage with and latch about latch receiving area 12*a* of elongated bar section 12**.

Figure 1:
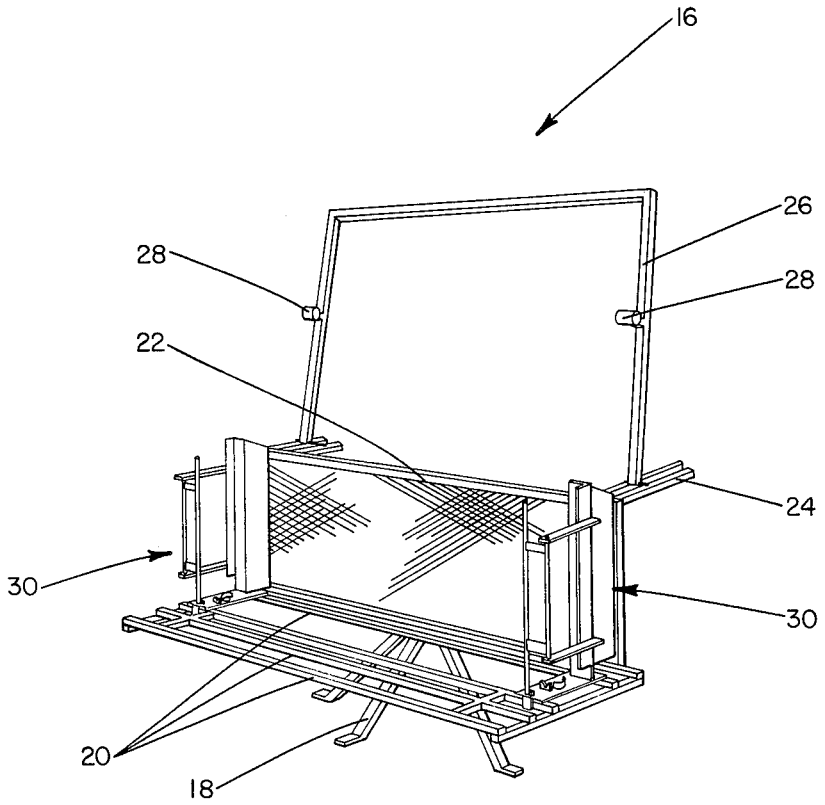
FIG. 1 is a perspective view of the bulk tobacco rack loading device of the present invention.

Now turning to the bulk tobacco racking device of the present invention, it is seen that the same is indicated generally by the numeral 16 in FIG. 1. Bulk tobacco racking device 16 is of a general open frame structure and is provided with an upstanding support structure 18 for supporting the same. At this point, reference is made to U.S. Pat. No. 4,016,985 which discloses a bulk tobacco racking device and this disclosure is expressly incorporated herein by reference. From a review of the racking device shown in U.S. Pat. No. 4,016,985, it is seen that the same can be supported above the ground or floor level and can in fact be designed such that two racking stations are provided in back to back relationship. Although not specifically shown herein, it is further noted that such racking stations can be placed on a turn table as is presently done with the racking devices manufactured and sold by Green-Wheeler Corporation of Angier, N.C.

Continuing to refer to the bulk tobacco racking device 16, it is seen that the same is of a generally open type frame construction including a bottom structure 20 that is formed by a plurality of rectangular metal stock members welded or otherwise secured to form a tobacco material receiving area. Secured to the bulk tobacco racking device 16 is a screen or expanded metal type bulk head 22 that extends upwardly from the bottom 20.

In addition the bulk tobacco racking device 16 is provided with a press support frame structure 24 that supports a press arm 26 that is pivotably mounted for swinging up and down movement relative to bottom 20. Secured to opposite sides of press arm 26 are a pair of engaging feet 28 that act to engage tine section 14 of the bulk tobacco rack 10 during the loading and racking operation.

Figure 2:
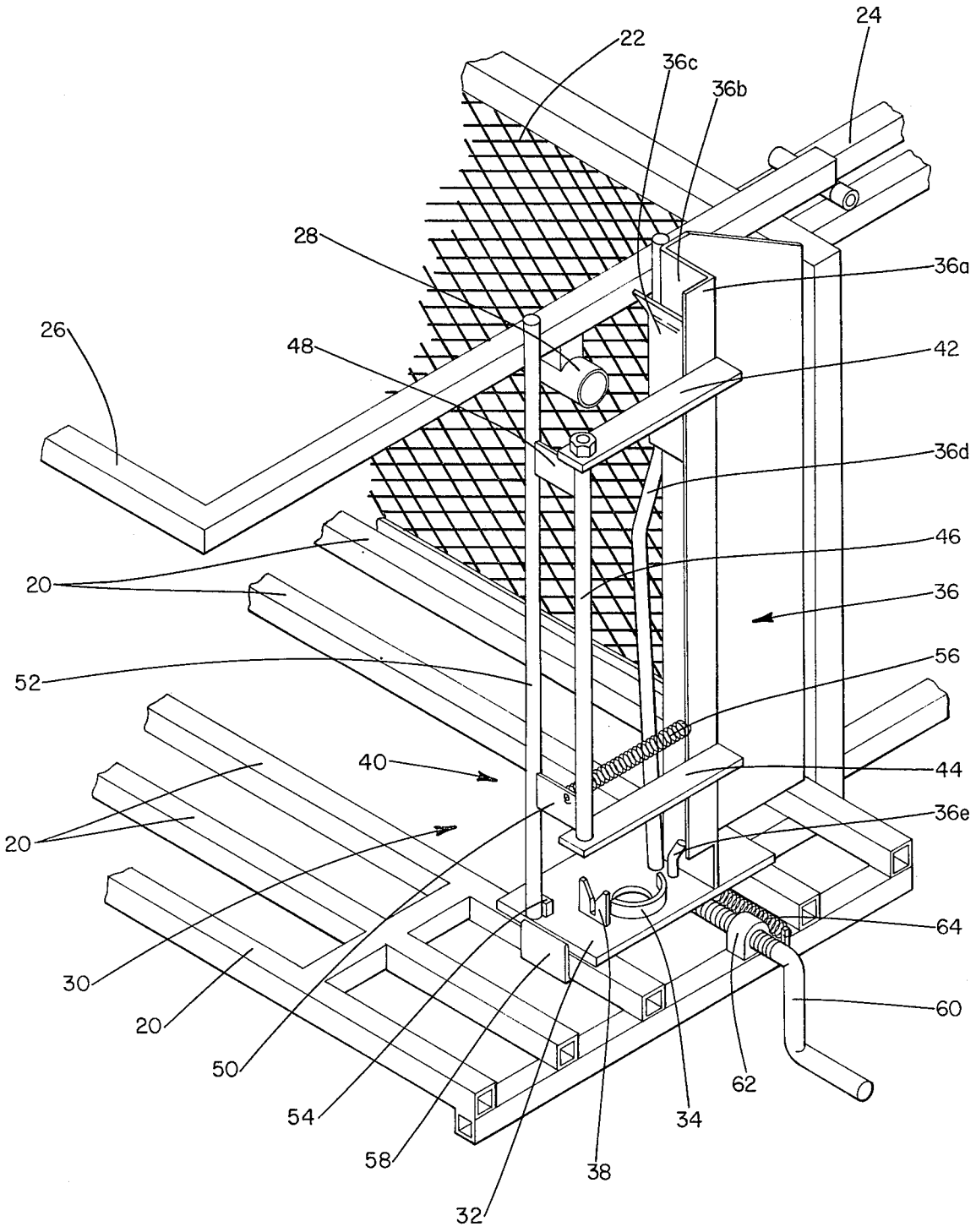
FIG. 2 is a fragmentary perspective view of one side of the bulk tobacco rack loading device of the present invention, especially illustrating one of the side frame assemblies that is adjustable laterally back and forth.

As illustrated in FIG. 1, and as particularly shown in FIG. 2, a pair of side frame assembly means are provided on each side of the racking device 16, with the side frame assembly means being indicated generally by the numeral 30. For purposes of illustration, reference is particularly made to FIG. 2 for a detailed understanding and appreciation of each respective side frame assembly means 30.

In this regard, it is seen that each side frame assembly means includes a platform 32 that includes a stop 34 secured thereto. The purpose of stop 34 is to limit the movement of elongated bar section 12 when the same is disposed within bulk tobacco racking device 16.

Side frame assembly means 30 further includes a racking guide assembly indicated generally by the numeral 36. Racking guide assembly 36 is welded or otherwise secured to the back portion of platform 32 and extends upwardly therefrom. An L-shaped forward portion indicated by **36*a* forms a part of the racking guide assembly 36 and includes a forward facing flange guide surface 36*b*. Secured to the L-shaped structure 36*a*is a forward retainer 36*c* that is spaced forwardly from flange engaging surface 36*b*. The forward spacing of retainer 36*c* defines a space between the retainer 36*c* and flange engaging surface 36*b*. This defined space is provided to accommodate flange 14*c* extending outwardly from each end of tine section 14 of the bulk tobacco rack 10**.

In addition racking guide assembly 36 further includes an elongated rod **36*d* that is particularly bent and shaped to lie outside of the plane of the tine section 14*a* at its upper extremity but to curve generally inwardly towards the plane of the tine section towards its downward extension such that it tends to extend behind the respective tine section ends 14*b* as the same during loading is directed downwardly within the bulk tobacco racking device, as will be understood better from subsequent discussions. In addition there is provided a stub rod 36*e* fixed to platform 32 just forwardly of rod 36*d*. It is appreciated that there is a space defined between stub rod 36*e* and rod 36*d*. About the opposite side of main stop 34 is a V-shaped guide 38 that is also secured to platform 32**.

Also forming a part of each side retaining frame assembly means 30 is a side retaining assembly indicated generally by the numeral 40. Viewing side retaining assembly 40, it is seen that the same includes a pair of vertically spaced arms 42 and 44 that are secured to the racking guide assembly 36 and extend forwardly therefrom. A sleeve 46 is rotatively journaled around a shaft (not shown) that is secured between arms 42 and 44. A pair of tabs 48 and 50 project from sleeve 46 and connect to an elongated retaining post 52. Retaining post 52 is movable from an inside position (shown in FIG. 2) to an outside position by rotating supporting sleeve 46, with the rotation being counterclockwise as viewed from the top of the bulk tobacco racking device 16 shown in FIG. 2. To bias the side retaining assembly and the retaining post 52 towards the inside position, there is provided a spring 56 anchored as shown in FIG. 2. There is also provided a stop 54 that establishes the extreme inside position.

The side frame assembly means 30 disposed on both sides of the racking device are functionally alike except that one such side frame assembly means can be provided with means to laterally adjust its position with respect to the bottom 20 or the other opposed side retaining means. In this regard reference is made to FIG. 2 wherein platform 32 is provided with U-shaped retainers 58 that extend around selected rectangular stock members of the bottom 20. Consequently, these rectangular stock members serve as guide rails inasmuch as the retainers 58 allow the platform 32 to slide laterally back and forth thereon. To provide for lateral adjustment, it is appreciated that such could be done in various ways. In one contemplated design, this is accomplished by the provision of a threaded crank 60 that is retained within a holder 62. Crank 60 is in turn operatively engaged with the platform 32 such that its rotation within a threaded member attached to the platform results in the platform being moved laterally back and forth depending on the direction of rotation of crank 60. It is appreciated that a number of other arrangements could be provided for moving the platform 32 in a like manner.

In operation press arm 26 is raised to its elevated position as shown in FIG. 1. Elongated bar section 12 of the bulk tobacco rack 10 is placed within the racking device such that its opposite ends are supported by the respective platforms 32. The position of one of the platforms is adjusted by crank 60 to where the bar section 12 is held between stops 34, but not held so tightly that the same cannot easily be removed once the loading and racking operation has been completed.

Once bar section 12 has been disposed within the racking device 16, tobacco leaf material is then laid horizontally over the elongated bar section 12 and supported by the bottom 20 of the bulk tobacco racking device 16. Tobacco leaf material is continually deposited until a selected quantity is held and supported within the racking device 16. It is appreciated that during the loading operation that the side retaining assemblies 40 and particularly the retaining posts 52 confine the tobacco leaf material along the sides of the racking device 16.

Once a sufficient quantity of tobacco leaf material has been deposited within the bulk tobacco racking device 16, tine section **14*a* is elevated above the racking device 16 by hand and is aligned such that the lower portions of flanges 14*c* align with the opening between retainer 36*c* and flange engaging surface 36*b* forming a part of the racking guide structure 36. Once flange 14***c* is accordingly aligned, tine section 14 is then pressed downwardly towards bottom 20 and elongated bar section 12, with flanges 14*c* being confined within the racking guide structure 36.

At the beginning the tine section 14 can be started through the tobacco leaf material by hand. But once a point is reached where substantial pressure is required, then the press arm 26 is rotated downwardly to where feet 28 engage the top or base portion 14*a* of the tine section 14. Then with the mechanical advantage gained by the press arm, an individual pushes or pulls downwardly by gripping the forwardmost portion of the press arm 26, causing the tine section 14 to be pressed downwardly through the tobacco material towards the elongated bar section 12. It follows, as tine section 14 is pressed and moved downwardly that the respective tines 14*f* engage and penetrate through tobacco leaf material lying in the volume of tobacco held and confined between the side retaining assembly 40.

Again it must be emphasized that as tine section 14 is pressed downwardly that flanges 14*c* are confined within the racking guide structure 36 and this confinement assures that the tine section 14 is being directed in proper alignment with the underlying elongated bar section 12*a*.

As the lower portions of ends 14*b* begin to come closer to platform 32, the presence of adjacent guide structure on opposite sides of stop 34 will assure proper latching engagement of latch 14*d*. In this regard the space between stub rod 36*e* and rod 36*d* adjacent the platform 32 and the guide structure provided by V-shaped guide 38 will insure that the lower portion of ends 14*b* are directed to the elongated arm section 12 such that latch 14*d* will properly align with the latch receiving area 12*a* formed about opposite ends of the bar section 12. It is appreciated that the lower ends of the end portions 14*b* of tine section 14 will be constrained to move into the V-shaped guide 38 and between stub rod 36*e* and rod 36*d*. Sufficient pressure is finally exerted by press arm 26 such that the latching lip 14*e* due to its spring steel nature, snaps into latching engagement within the latch receiving area or opening 12*a*. At this point, the two rack sections have been secured together and the tobacco leaf material is securedly confined therebetween.

Once the rack has been loaded and securely latched, the press arm 26 will be returned to its vertical position, and the entire rack can be engaged and pulled forward from the bulk tobacco racking device 16 without opening any doors or making any other adjustment. This is because the side retaining assemblies 40, which projects inwardly past the ends 14*b* of the tine section, are spring loaded to move from the inside position outwardly therefrom towards an outside position in response to the tobacco rack 10 and the racked tobacco leaf material engaging the same as the bulk tobacco rack is pulled from the racking device.

From the foregoing discussion, it is appreciated that the bulk tobacco racking device of the present invention presents a relatively simple and useful device for use in conjunction with a bulk tobacco rack such as the type shown in FIG. 3. Of principal importance is the fact that the racking table provides adjustable side frame assemblies that compensate for variances in length of such racks. In addition the respective side frame assemblies 30 are designed to engage the tine section in a guiding fashion so as to properly align the same with the underlying elongated bar section. It may be pointed out at this point that the guide structure of the respective side frame assemblies 30 can be slanted or inclined slightly downwardly and rearwardly so as to allow the press arm to be very effective in its operation and to reduce the tendency of the tine section 14*a* to move forwardly about its penetrating side during the pressing operation.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A bulk tobacco racking device for assisting in the loading of a bulk tobacco rack of the dual sectional type having a tine section, a mating elongated bar section, and latch means extending from one section and operative to engage the other section so as to create a coupled relationship between the two rack sections to form said bulk tobacco rack, said bulk tobacco racking device comprising:

a. a bottom that underlies said elongated bar section of said bulk tobacco rack and generally acts to support tobacco leaf material during the rack loading operation;

b. a pair of laterally spaced side frame assembly means extending generally upwardly in laterally spaced apart relationship about opposite sides of said bottom for receiving respective sections of said bulk tobacco rack therebetween and for assisting in loading tobacco leaf material between the two bulk tobacco rack sections; said laterally spaced side frame assembly means including;

1. means for laterally adjusting and moving at least one of said side frame assembly means laterally back and forth relative to said bottom in order that the span between said side frame assembly means can be properly adjusted to receive the respective sections of said bulk tobacco rack;

2. stop means associated with each of said side frame assembly means for generally maintaining said elongated bar section stationary once the same has been placed within the racking device;

3. side retaining means extending generally vertically about the end areas normally occupied by said bulk tobacco rack for retaining tobacco leaf material within the racking device as the tobacco leaf material is deposited and loaded over said elongated bar section during the loading operation;

4. guide means for engaging said tine section and generally directing the same downwardly towards said elongated bar section as the same is pushed downwardly such that the two rack sections are properly aligned in order that the latch of one section will properly align, engage and latch with the other section such that once latched tobacco leaf material will be confined within the two rack sections and generally be held therein by the presence of tines extending from said tine section;

c. press means associated with said racking device for engaging said tine section, after the racking device has been loaded with tobacco leaf material and the tine section has been properly aligned and engaged with said guide means of said side frame assembly means, for pressing said tine section downwardly towards said elongated bar section such that said latch means of one section will effectively engage and latch the other section so as to couple the two sections of said bulk tobacco rack together; and d. wherein said side retaining means of said side frame assembly means is movable between an inside position and an outside position and is normally biased to assume said inside position, whereby said side retaining means can move from said inside position toward said outside position in response to said bulk tobacco rack engaging the same as the bulk tobacco rack is pulled from the racking device.

2. The bulk tobacco racking device of claim 1 wherein said side retaining means are rotatively mounted about a vertical axis and swingable thereabout from said inside position to said outside position.

3. The tobacco racking device of claim 1 wherein each side frame assembly means includes a platform for receiving an end section of said elongated bar section of said bulk tobacco rack wherein said stop means is disposed closely adjacent said platform; and wherein said guide means includes guide structure disposed closely adjacent said platform for guiding said tine rack section into proper latched engagement with said elongated bar section.

4. The bulk tobacco racking device of claim 3 wherein said tine section is generally U-shaped including an elongated base section and two end sections with tines extending from said base section and with each end section including a projecting flange, and wherein said guide means of said side frame assembly means is adapted to receive said flange and to constrain its movement to assure that the tine section is properly aligned and directed into engagement with said elongated bar section.

5. The bulk tobacco racking device of claim 4 wherein said guide means for receiving said flange includes fore-and-aftly spaced apart members that define a space therebetween that allows said flange to be inserted within said defined space and to move downwardly through the same as said tine rack section is pressed towards latching engagement with said elongated bar section.

6. The bulk tobacco racking device of claim 3 wherein there is provided guide rail means and wherein the platform of at least one of said side frame assembly means is movably mounted thereon; and wherein said means for movably adjusting at least one of said side frame assembly means includes means for moving said platform laterally back and forth along said guide rail means.

7. The bulk tobacco racking device of claim 6 wherein said means for moving said platform laterally back and forth includes a threaded crank operatively connected to said platform for moving the same back and forth in response to said crank being turned.

8. A method of loading a multi-sectional tobacco rack of the type including a tine section with a pair of flanges extending therefrom, a mating section, and latch means for securing the two sections together, comprising the steps of: horizontally positioning said mating section within a racking device; placing tobacco leaf material over said mating section and confining the tobacco material along opposite sides to form a volume of tabacco leaf material; inserting said flanges of said tine section within a guiding structure aligned with said mating section; pressing said tine section downwardly through the tobacco leaf material and constraining said flanges to pass downwardly through said guide structure; engaging and guiding the lower outside ends of said tine section downwardly into latched engagement with said mating section to couple said rack sections together; confining the tobacco leaf material inwardly of the outside areas occupied by said tine section when the same is inserted and pressed downwardly through the tobacco leaf material; and after said rack sections have been latched and coupled together pulling said coupled rack forwardly from said racking device such that the same engages tobacco leaf retaining means and causing said tobacco leaf retaining means to move outwardly such that said coupled rack can be removed from said racking device.

9. The method of claim 8 including the step of laterally adjusting said guiding structure to accommodate the particular length of the respective sections of said bulk tobacco rack.

10. A bulk tobacco racking device for assisting in the loading of a bulk tobacco rack of the multisectional type having a time section including flange means extending outwardly therefrom, an elongated mating section, and latch means extending from one section and operative to engage the other section so as to create a coupled relationship between the two rack sections to form said bulk tobacco rack, said bulk tobacco racking device comprising: a main frame structure including a bottom that is adapted to underlie said elongated mating section when said racking device is being used; a pair of laterally spaced side frame assembly means extending generally upwardly in laterally spaced apart relationship about opposite sides of said bottom for receiving respective sections of said bulk tobacco rack therebetween and for assisting in loading tobacco leaf material between the two bulk tobacco rack sections, said side frame assembly means including guide means for receiving said flange means and constraining said flange means to be held within said guide means as said tine section is pressed downwardly towards said elongated mating section; at least one of said side frame assembly means being provided with means for laterally adjusting and moving the same laterally back and forth relative to said bottom for adjusting the span between said side frame assembly means to receive the respective sections of said bulk tobacco rack; press means associated with said racking device for engaging said tine section and pressing the same downwardly towards said elongated mating section such that said latch means of one section will effectively engage and latch the other section so as to couple the two sections together; said side frame assembly means including side retaining means extending generally vertically about opposite sides of said bottom for confining tobacco leaf material about opposite vertical sides of said bottom during the loading operation; and wherein said side retaining means includes means for movably mounting the same for movement between inside and outside positions wherein in said inside position said side retaining means extends inwardly past the vertical ends of said rack when disposed within said racking device, and wherein there is provided biasing means operatively connected to said side retaining means for biasing the same towards said inside position.

* * * * *